US009138608B2

(12) United States Patent
Medina

(10) Patent No.: US 9,138,608 B2
(45) Date of Patent: Sep. 22, 2015

(54) SELF AND MANUALLY ADJUSTABLE EXERCISE DEVICE

(71) Applicant: Alberto Medina, Stafford, VA (US)

(72) Inventor: Alberto Medina, Stafford, VA (US)

( * ) Notice: Subject to any disclaimer, the term of this patent is extended or adjusted under 35 U.S.C. 154(b) by 225 days.

(21) Appl. No.: 13/834,243

(22) Filed: Mar. 15, 2013

(65) Prior Publication Data

US 2014/0274594 A1 Sep. 18, 2014

(51) Int. Cl.

| | |
|---|---|
| ***A63B 21/00*** | (2006.01) |
| ***A63B 21/065*** | (2006.01) |
| ***A63B 23/04*** | (2006.01) |
| *A63B 21/06* | (2006.01) |
| *A63B 21/072* | (2006.01) |

(52) U.S. Cl.

CPC ..... *A63B 21/065* (2013.01); *A63B 21/1411* (2013.01); *A63B 23/0405* (2013.01); *A63B 21/0602* (2013.01); *A63B 21/0603* (2013.01); *A63B 21/0609* (2013.01); *A63B 21/072* (2013.01); *A63B 21/0724* (2013.01); *A63B 21/0726* (2013.01); *A63B 2023/0411* (2013.01)

(58) Field of Classification Search

CPC ..... A63B 21/00

USPC ..... 482/105, 124, 148, 83, 93; 602/4, 19; 128/873, 874, 875

See application file for complete search history.

(56) References Cited

U.S. PATENT DOCUMENTS

| | | | | |
|---|---|---|---|---|
| 967,454 | A * | 8/1910 | small | 2/328 |
| 1,793,776 | A * | 2/1931 | Clayton | 602/19 |
| 4,371,162 | A | 2/1983 | Hartzell | |
| 4,589,658 | A | 5/1986 | Gibson | |
| 5,088,728 | A | 2/1992 | Deden | |
| 5,167,600 | A | 12/1992 | Baird | |
| 5,472,398 | A * | 12/1995 | Silverman | 482/105 |
| 5,743,837 | A | 4/1998 | Dias et al. | |
| 5,916,070 | A | 6/1999 | Donohue | |
| 6,022,298 | A | 2/2000 | Svedarsky et al. | |
| 6,125,792 | A | 10/2000 | Gee | |
| 7,037,281 | B1 * | 5/2006 | Jeffrey et al. | 602/4 |
| 7,044,896 | B2 | 5/2006 | Hetrick | |
| 7,549,948 | B2 | 6/2009 | Makofsky | |
| 7,735,150 | B2 | 6/2010 | Wolfe | |
| 8,657,076 | B2 * | 2/2014 | Beaudry | 187/409 |
| 2004/0043877 | A1 | 3/2004 | Brown | |
| 2007/0238591 | A1 * | 10/2007 | Makofsky | 482/126 |
| 2009/0011909 | A1 | 1/2009 | Glisan | |
| 2010/0144501 | A1 | 6/2010 | Berhanu | |
| 2010/0274166 | A1 | 10/2010 | Terrio | |

* cited by examiner

*Primary Examiner* — Jerome w Donnely

(57) ABSTRACT

A self and manually adjustable exercise device includes a pair of shoulder portions attached to each other. Each shoulder portion forms a respective loop around and engages with a respective shoulder region of a human torso. Each shoulder portion includes a respective belt portion that forms the respective loop, and a respective load coupling structure connected to the respective belt portion to self-adjust a respective position at which the respective load coupling structure connects to the respective belt portion when the respective load coupling structure connects to a respective load.

19 Claims, 5 Drawing Sheets

SELF AND MANUALLY ADJUSTABLE EXERCISE DEVICE

CROSS-REFERENCE TO RELATED APPLICATIONS

This application is based on applicant's provisional patent application having application No. 61/622,440, filed on Apr. 10, 2012.

TECHNICAL FIELD

This disclosure relates to exercise devices.

BACKGROUND

Exercise devices assist individuals to perform various exercises, for example, exercises directed at the development of the legs. The lunge is a leg-development exercise, which can be performed without or with the use of weights (for example, free weights such as dumbbells, kettlebells, and the like) held by the hands—for example, one in each hand—and supported by the arms. One's performance of the lunge by carrying weights in one's hands can be affected by an amount of the weight that one can support over the period of the exercise and a stress that can be placed on one's joints and surrounding connective tissue by supporting the weights. Some exercise devices or machines aid in the physical development or exercising of the legs and serve as alternatives to free weights. Many of these devices are stationary. Such non-portable exercise devices can be used to exercise one part or isolated muscle group of the legs.

SUMMARY OF THE INVENTION

This disclosure describes a self and manually adjustable exercise device.

In general, one innovative aspect of the subject matter described here can be implemented as an exercise device that includes a left shoulder portion and a right shoulder portion. The left shoulder portion is configured to form a left loop around and engage with a left shoulder region. The left shoulder portion further includes a left belt portion that forms the left loop, and a left load coupling structure connected to the left belt portion to self-adjust a position at which the left load coupling structure connects to the left belt portion when the left load coupling structure is connected to a first load. The right shoulder portion is attached to the left shoulder portion and configured to form a right loop around and engage with the right shoulder region. The right shoulder portion further comprises a right belt portion that forms the right loop, and a right load coupling structure connected to the right belt portion to self-adjust a position at which the right load coupling structure connects to the right belt portion when the right load coupling structure is connected to a second load.

This, and other aspects, can include one or more of the following features. The left load coupling structure can include a first hollow portion through which the left belt portion passes to form the left loop. The left load coupling structure can include an extension structure that connects the first load to the left load coupling structure. The extension structure can include a belt of adjustable length. The exercise device can include a locking mechanism connected to the extension structure to adjustably fix a length of the extension structure. The left load coupling structure can include a hook structure to receive the first load. The left load coupling structure can be a plate in which the first hollow portion is formed. The plate can be connected to a hook structure. The left load coupling structure can be configured to slide along the left belt portion when the left load coupling structure is connected to the first load. The left load coupling structure and the right load coupling structure can each be configured to automatically slide downward on the left belt portion and the right belt portion, respectively, when the left load coupling structure and the right load coupling structure are connected to the first load and the second load, respectively, and when the left shoulder portion and the right shoulder portion are engaged with the left shoulder region and the right shoulder region, respectively. An engagement of the left shoulder portion and an engagement of the right shoulder portion can be manually adjustable when engaged with the left shoulder region and the right shoulder region, respectively. The left load coupling structure and the right load coupling structure can be configured to slide on the left belt portion and on the right belt portion, respectively, when the left shoulder portion and the right shoulder portion engage with the left shoulder region and the right shoulder region, respectively. The right shoulder portion can substantially mirror the left shoulder portion. The first load can be an exercise weight.

Another innovative aspect of the subject matter described here can be implemented as an exercise device that includes a pair of shoulder portions attached to each other. Each shoulder portion is configured to form a respective loop around and engage with a respective shoulder region of a human torso. Each shoulder portion includes a respective belt portion that forms the respective loop, and a respective load coupling structure connected to the respective belt portion to self-adjust a respective position at which the respective load coupling structure connects to the respective belt portion when the respective load coupling structure connects to a respective load.

This, and other aspects, can include one or more of the following features. Each load coupling structure can be configured to slide along the respective belt portion when each load coupling structure is connected to the respective load. Each load coupling structure can be configured to slide downward on the respective belt portion when each load coupling structure is connected to the respective load, and when the pair of shoulder portions are engaged with the shoulder region. An engagement of each shoulder portion can be manually adjustable when the pair of shoulder portions are engaged with the shoulder region. Each load coupling structure can be configured to slide on the respective belt portion when the pair of shoulder portions engage with the shoulder region. Each load coupling structure can be configured to automatically slide to a respective lowest vertical position on the respective belt portion when each load coupling structure is connected to the respective load. Each load connected to each load coupling structure can be an exercise weight.

The details of these and other aspects and implementations of the present disclosure are set forth in the accompanying drawings and the description below. Other features and advantages of the disclosure will be apparent from the description and drawings, and from the claims.

BRIEF DESCRIPTION OF DRAWINGS

Like reference numbers and designations in the various drawings indicate like elements.

DETAILED DESCRIPTION

Figure 1:
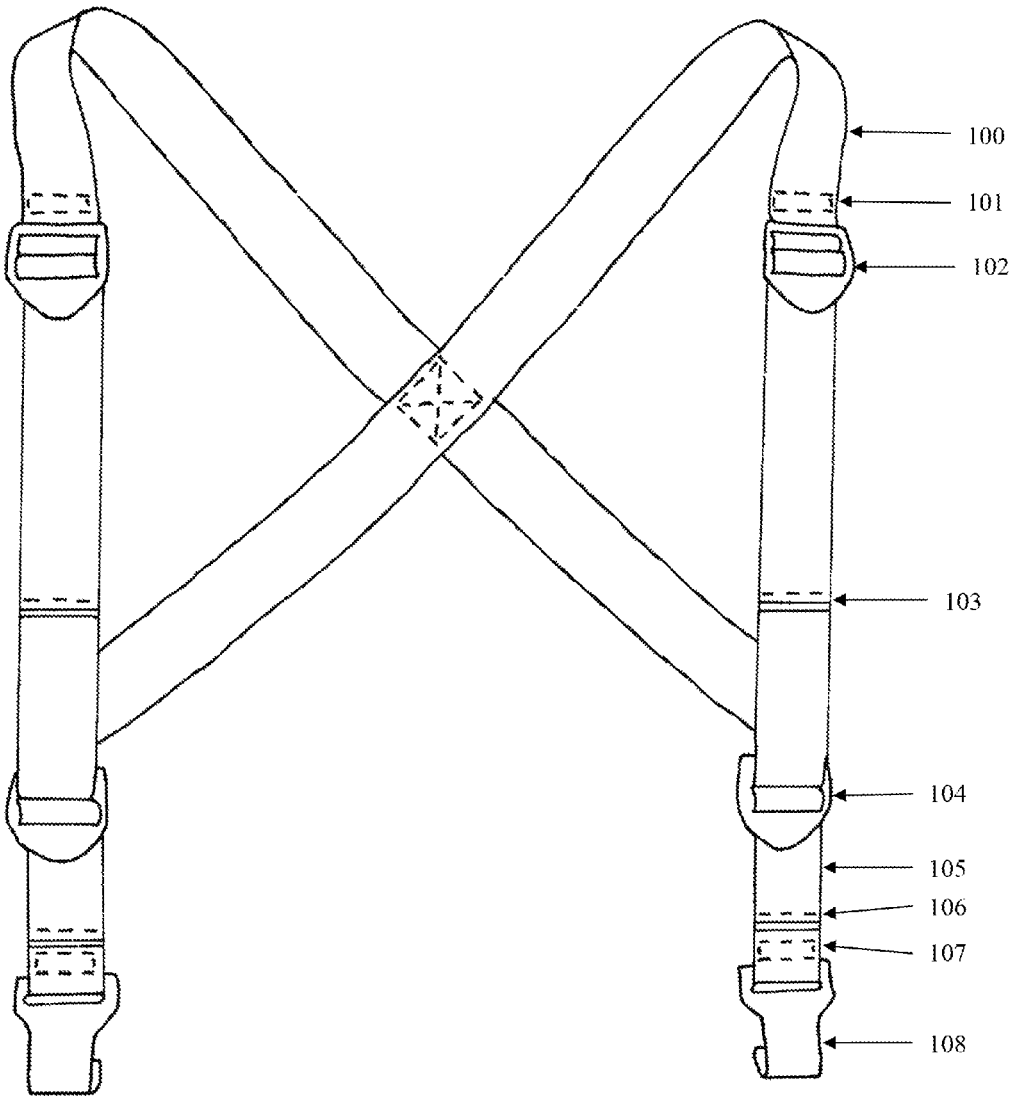
FIG. 1 is a schematic front view of an adjustable exercise device.

This specification describes an exercise device that is both self-adjusting and manually adjustable. The exercise device can include inelastic (or minimally elastic) straps and interfaces coupled to form a harness that can be worn by a user of the exercise device around the left and right shoulder regions. Specifically, for example, a left inelastic strap can form a left loop around and engage with a left shoulder region. Similarly, a right inelastic strap can form a right loop around and engage with a right shoulder region. The position of the exercise device around the shoulder regions can be adjusted by moving the respective inelastic straps. In addition, the inelastic straps can include respective interfaces, described below, to adjust a length of the inelastic strap around the shoulder region up to a pre-determined limit. Each interface allows a length of each inelastic strap to be increased or decreased up to the pre-determined limit.

The inelastic straps further include load coupling structure to which respective exercise loads, for example, exercise weights, can be coupled. An exercise weight can include a dumbbell, a kettle ball, a weight plate, a bag or bags filled with sand or water or both, chains, chains with coupling structures to connect the exercise device to other exercise devices or machines, and the like. In general, any structure that can provide resistance while using the exercise device to perform exercises can be an exercise load. In this manner, the load coupling structure can support the exercise loads when the exercise device is looped around and engaged with the user's shoulder regions. As described below, a position of each load coupling structure on the respective inelastic strap is both self and manually adjustable. When the inelastic straps of the exercise device are engaged around the shoulder regions, the respective load coupling structures are free to slide vertically downward on the inelastic straps under their own weight without user intervention. Alternatively, or in addition, the user can manually slide each load coupling structure along the respective inelastic strap. The load coupling structure can also slide vertically downward, for example, to the lowest point on the respective inelastic strap, without user intervention, when coupled to an exercise load.

Implementations of the subject matter described in this specification can provide one or more of the following potential advantages. Because the exercise loads are supported by the load coupling structures, which, in turn, are supported by the inelastic straps that engage with the user's shoulder regions, the user need not support the exercise loads with the user's arms and hands. This transfers the weight of the exercise loads from the user's hands to the user's shoulder and back regions, which may be able to support greater weight than the arms and hands. Consequently, stresses on the arms and hands, and the associated joints can be decreased. Thus, when a user performs leg exercises, such as lunges or squats, using the exercise device, the user can perform the exercise for a longer duration and can support a heavier weight than if the user performed the exercises by holding the weights in the arms and hands. While performing the exercise, the user need not use the arms to support the exercise loads, but only to stabilize the exercise loads and prevent them from swinging freely.

Further, the self and manually adjustable features of the load coupling structure allow the user to adjust the engagement of the exercise device around the shoulder regions. Users of different heights can adjust the lengths of the inelastic straps up to the pre-determined limit described above. In addition, a user may desire to further adjust the position of the exercise device in its entirety. For example, the user may insert the user's left and right arms into the left and right shoulder regions to wear the exercise device as a harness, and then, using the hands, pull each inelastic strap vertically downward or upward to adjust a position of the exercise device around the shoulder regions and the back (or around the breast region for female users). In such situations, fixing a position of the load coupling structure on the elastic strap such that the structure cannot move along the strap constrains an amount by which the user can adjust the exercise device. Moreover, even if the user adjusted the exercise device as desired, when the exercise load is coupled to the fixed position of the load coupling structure, the inelastic straps would slide away from the user's desired position due to the weight of the exercise load.

On the other hand, because the load coupling structure of the exercise device described here can freely slide along the inelastic strap, the user can adjust the position of the exercise device to any convenient position. Subsequently, when the exercise load is coupled to the load coupling structure, only the load coupling structure and not the entire exercise device will slide vertically downward. Moreover, the weight of the exercise load at the lowest vertical point can serve to lock a position of the exercise device around the user's shoulder regions so that the exercise device does not slide around the shoulder regions while the user is exercising.

Because the load coupling structure is self-adjusting, it can continuously adjust its center of gravity as various exercises are being performed. By doing so, the load coupling structure can automatically provide an optimal position for the exercise weight. Even with the self-adjusting feature, the user can still have full control and can instantly make manual adjustments as needed. In some situations, the exercise device can include multiple length adjusters to accommodate variations in body types and possible body abnormalities.

FIG. 1 is a schematic front view of an example exercise device. As described in detail below, the exercise device includes a left shoulder portion configured to form a left loop around and engage with a left shoulder region. The left shoulder portion further includes a left belt portion that forms the left loop, and a left load coupling structure connected to the left belt portion to self-adjust a position at which the left load coupling structure connects to the left belt portion when the left load coupling structure is connected to a first load. The exercise device also includes a right shoulder portion attached to the left shoulder portion and configured to form a right loop around and engage with the right shoulder region. The right shoulder portion includes a right belt portion that forms the right loop, and a right load coupling structure connected to the right belt portion to self-adjust a position at which the right load coupling structure connects to the right belt portion when connected to a second load. As described below, in some implementations, the left shoulder portion and the right shoulder portion substantially mirror each other. In some implementations, the left shoulder portion and the right shoulder portion may be different from each other or can include more or fewer features relative to each other.

In some implementations, the left belt portion can be formed using a two-piece strap 100 that can be inelastic or have very minimal elasticity. The strap 100 can be formed using any suitable material, for example, nylon, leather, polypropylene, polyester, cotton, or other polymer. In some implementations, a first end 101 of one of the pieces of the strap 100 can be connected, for example, stitched, to an adjustable interface 102. The second end 103 of the strap 100 can be formed to provide a safety feature that prevents the strap from sliding out of the interfaces 102. The safety feature can be formed by folding the end of the strap multiple times and stitching the folded end to form a stop were the strap to slide. The interfaces 102 are manually adjustable and allow the user to adjust the overall fit of the exercise device for length, comfort, and proper implementation during the execution of various exercises. Interfaces similar to those described with reference to the left strap 100 can be disposed on the right strap. The interface (or interfaces) disposed on the left can be independent of the interface (or interfaces) disposed on the right, and can be manually adjustable based on the respective side of the torso. Similarly to the strap 100 on the left belt portion, a first end of the counterpart strap on the right belt portion can be connected to an adjustable interface. The second end of the counterpart strap can be formed to provide a safety feature that prevents the strap from sliding out of the counterpart interface.

As described above, a position of the load coupling structure that is connected to the belt portion is self and manually adjustable. For example, the interface 104 on the left belt portion is a self-adjusting interface that slides along the lower part of inelastic strap 100 to provide continuous proper positioning of the weights being employed during the execution of various exercises. In some implementations, the left load coupling structure can include a first hollow portion, for example, a loop structure, through which the left belt portion passes to form the left loop. Similarly, an interface on the right belt portion that is a counterpart of the interface 104 can also be self-adjusting and capable of sliding along the lower part of an elastic strap that is a counterpart of the inelastic strap 100. The counterpart interface can have substantially similar features as the interface 104.

The left load coupling structure can also include an extension structure that connects the first load to the left load coupling structure. The extension structure can include an inelastic strap 105 (or any belt of adjustable length) that can be connected on one end to the load coupling structure and on the other end to the exercise load. The inelastic strap 105 can be manually adjusted for arm length using interfaces 104. The right load coupling structure can similarly include a counterpart extension structure that connects the second load to the right load coupling structure. The pairing of inelastic strap 105 and interface 104 on the left inelastic strap 100 can be independent of the corresponding inelastic strap and interface on the right inelastic strap, and can be adjusted for a length of the corresponding left or right arm. In other words, a length of the right inelastic strap that connects the right load coupling structure to the right exercise load can be adjusted to be different from a corresponding length of the left inelastic strap that connects the left load coupling structure to the left exercise load.

In some implementations, a locking mechanism can be connected to the extension structure to adjustably fix a length of the extension structure. For example, the inelastic strap 105 can include two ends where multiple folds are formed on one end, for example, by stitching, to serve as a locking mechanism and to provide a safety feature that prevents the strap from sliding out of the interfaces 104.

In some implementations, the load coupling structure can include a hook structure to receive the exercise load. For example, the other end of the inelastic strap 105 can be attached to a hook 108, for example, by stitching or other fastening methods. The hook 108 can be designed and configured to hold the exercise loads, for example, the free weights, being employed during the execution of various exercises. In this manner, the hook 108 takes the place of the hands that would otherwise be carrying the weights.

The features of the left shoulder portion of the exercise device were described above. As described above, similarly to the left shoulder portion, the right shoulder portion of the exercise device can be attached to the right shoulder portion, and can be configured to form a right loop around and engage with the right shoulder region. The right shoulder portion can include a right belt portion that forms the right loop, and a right load coupling structure connected to the right belt portion to self-adjust a position at which the right load coupling structure connects to the right belt portion when connected to a second load. The left and right load coupling structures are configured to slide along the left belt portion and the right belt portion, respectively. Specifically, the left load coupling structure is configured to slide independently of the right load coupling structure (and vice versa). Further, each load coupling structure is configured to slide independently of the respective belt portion to which the structure is coupled.

When the exercise device is engaged around the shoulder regions, the coupling structures can either automatically slide downward along the belt portions by their own weight or can be manually slide to any desired position by the user. When the coupling structures are connected to the respective exercise loads, the structures automatically slide downward on the respective belt portions due to the weights of the respective loads. The coupling structures are supported by the respective belt portions, which, in turn, are supported by the shoulder regions around which the structures are engaged. The engagements of belt portions around the shoulder regions are manually adjustable. Even when the positions of the belt portions are adjusted, the load coupling structures slide freely along the belt portions, and ensure that the exercise weights remain, for example, at the vertically lowest positions on the belt portions. By using the anus to only stabilize the positions of the exercise weights, a user can perforin exercises such as lunges, squats, and the like.

Figure 2:
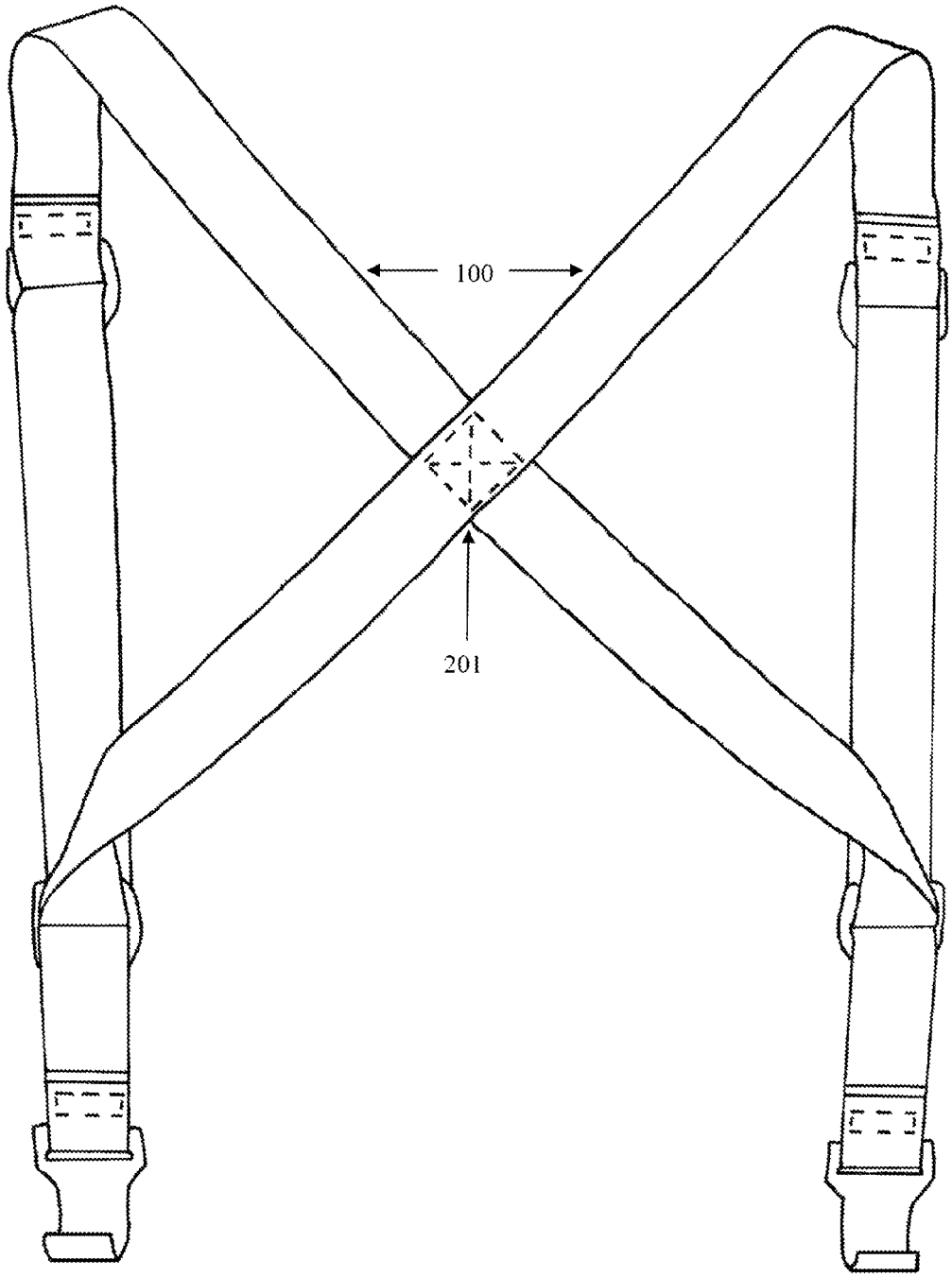
FIG. 2 is a schematic rear view of the adjustable exercise device of FIG. 1.
Figure 3:
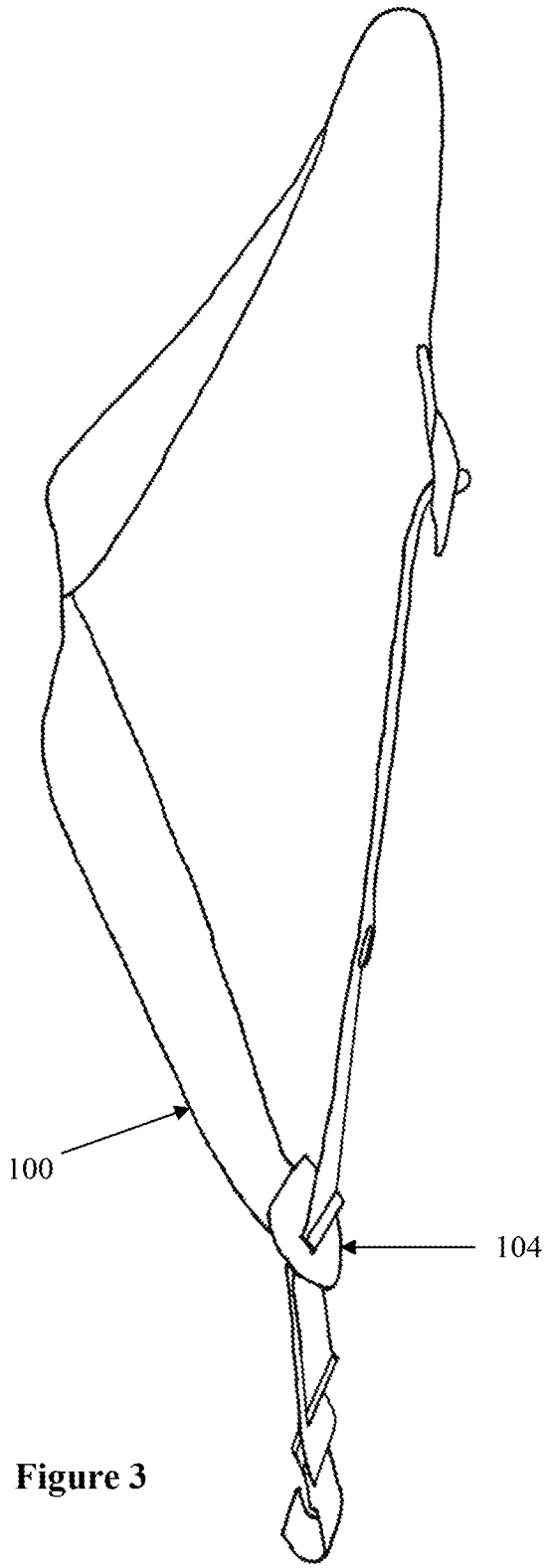
FIG. 3 is a schematic side view of the adjustable exercise device of FIG. 1.
Figure 4:
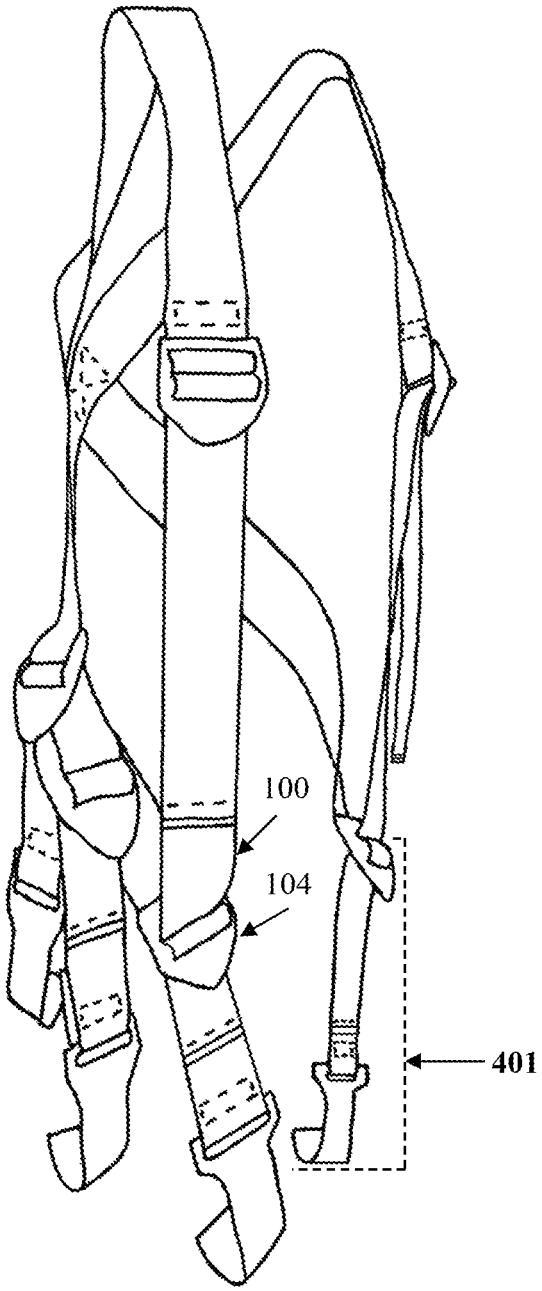
FIG. 4 is a perspective view of the adjustable exercise device of FIG. 1 and illustrates the self-adjusting mechanism in movement.

FIG. 2 is a schematic rear view of the exercise device illustrated in FIG. 1. The inelastic straps 100 can be secured by overlapping the straps in the back and stitching a back portion 201 of the straps to each other. FIG. 3 is a schematic side view of the exercise device illustrated in FIG. 1. FIG. 4 is a perspective view of the exercise device illustrated in FIG. 1. FIGS. 3 and 4 illustrate the self-adjusting mechanism of the coupling structure that permits the structure to freely glide along the belt portion providing the self-adjusting feature described above. The shoulder portion is configured to form a loop around and engage with a shoulder region of a human torso. The shoulder region includes a belt portion (i.e., the strap 100) that forms the loop. The belt portion includes a load coupling structure (i.e., the interface 104) that includes a loop structure through which the belt portion passes. The loop structure allows the load coupling structure to self-adjust a respective position at which the load coupling structure connects to the belt portion. As described above, the load coupling structure can include the interface 104, the inelastic strap 105, the first end 106, the second end 107, and the hook 108 (collectively, assembly 401).

As described above, each load coupling structure is configured to slide downward on the respective belt portion when each load coupling structure is connected to the respective load, and when the pair of shoulder portions is engaged with the shoulder region. An engagement of each shoulder portion is manually adjustable when the pair of shoulder portions is engaged with the shoulder region. Each load coupling structure is configured to slide on the respective belt portion when the pair of shoulder portions engages with the shoulder region. Each load coupling structure is configured to automatically slide to a respective lowest vertical position on the respective belt portion when each load coupling structure is connected to the respective load. Each load connected to each load coupling structure is an exercise weight.

Figure 5:
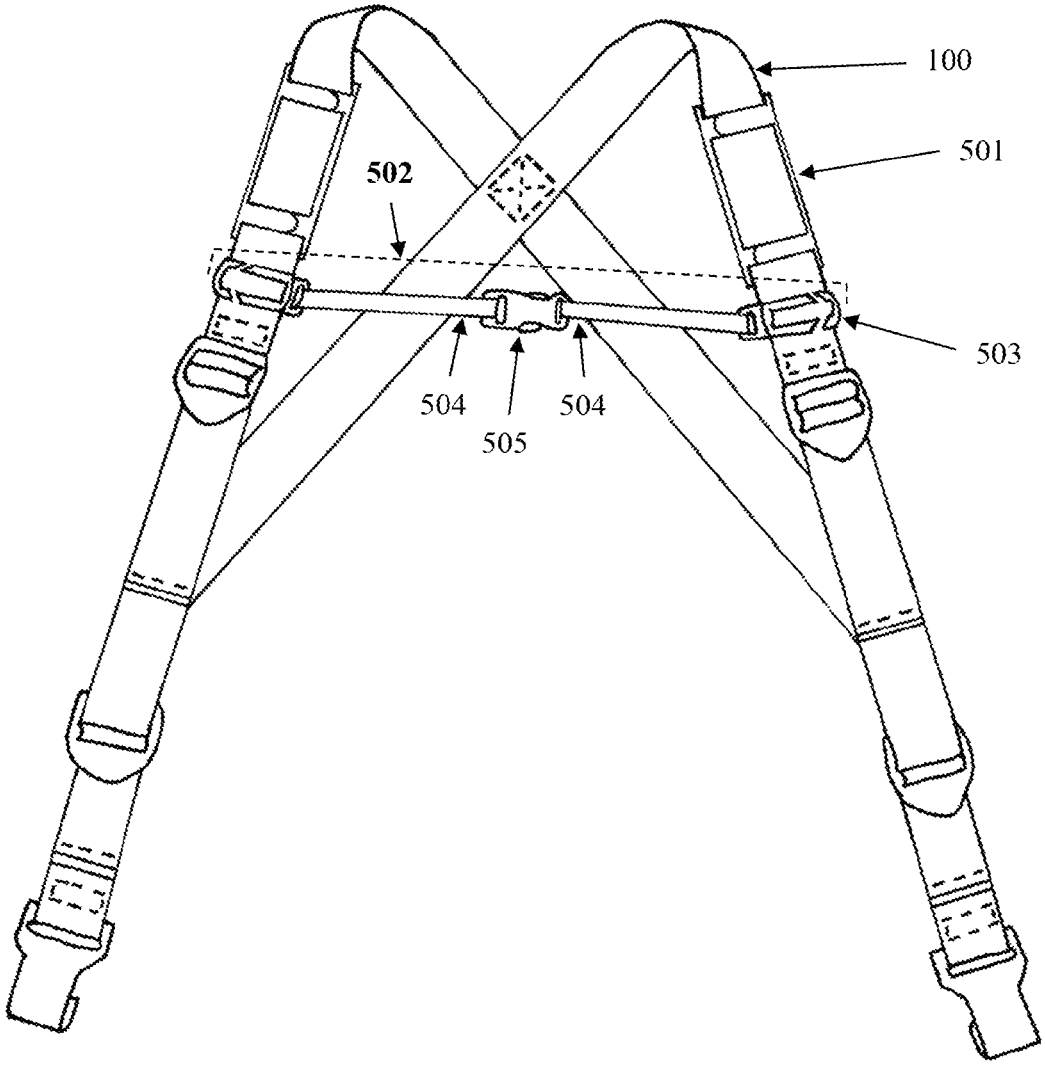
FIG. 5 is a schematic front view of the adjustable exercise device of FIG. 1 and illustrates shoulder pads and a chest strap.

FIG. 5 is a schematic front view of the exercise device shown in FIG. 1. The exercise device shown in FIG. 5 includes optional removable shoulder pads and optional removable chest strap. The shoulder pads 501 can provide support and comfort to the shoulder area of the user. The shoulder pads 501 can be removed from the exercise device or can be positioned along the upper part of inelastic straps 100 at a position which offers support and comfort to the user. Chest strap 502 is another optional feature that can provide support, comfort, and security. The chest strap 502 can also be removed or placed along inelastic straps 100 where the user can obtain the most benefit in terms of support, comfort, and security. The composition of chest strap 502 is comprised of interfaces 503, inelastic straps 504, and fastener 505.

In an exemplary use, a user will insert her right arm and left arm through the respective right loop and left loop formed by the right shoulder region and the left shoulder region, respectively. The user will adjust the positions of the right loop and the left loop on her left and right shoulders respectively. The user will additionally adjust a length of the right belt portion and the left belt portion according to her comfort. At this stage, the load coupling structures will either automatically slide downward along the belt portions or can manually be slid downward by the user. When the user loads exercise weights on the left and right hook members attached to the ends of the left and right load coupling structures, respectively, the structures may further slide vertically downward, for example, to the lowest possible positions on the belt. The user can use her arms to stabilize positions of the exercise weights, and perform a lunge or a squat or other exercises.

In some implementations, the load coupling structure can include a plate member having a loop-shaped hole formed at one end and shaped to form the hook at the other end. The belt portion can be passed through the loop-shaped hole, and the exercise load can be loaded on the hook. In this manner, the inelastic strap that connects the interface 104 to the hook can be replaced with the plate member.

In some implementations, the hook member can be replaced with other structures, for example, metal loop structures with spring gates (such as, carabiners) that can be coupled to other exercise equipment, for example, stationary exercise machines. In some implementations, the exercise device can be used for speed training exercises in which users drag heavy weights or are restrained, for example, by parachutes. The hook members can be replaced with suitable members (for example, the metal loop structures) to couple the exercise device to the heavy weights or the parachutes. In some implementations, the exercise device can be used in non-exercise situations to carry loads, for example, grocery bags, buckets of sand or water, and the like. Exercises that can be performed using the exercise device stated in this document include but are not limited to: lunge (many variations), squat, deadlift, calf raise, dip (several variations), shrug, pull-up, side-bend, and combination exercises such as lunge with arm curl, squat with hammer curl, and many others.

While this specification contains many specific implementation details, these should not be construed as limitations on the scope of any implementations or of what may be claimed, but rather as descriptions of features specific to particular implementations of particular implementations. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. An exercise device comprising:

a left shoulder portion forms a left loop around and engages with a left shoulder region, wherein the left shoulder portion further comprises:

a left belt portion that forms the left loop, and a left load coupling structure connected to the left belt portion to self-adjust a position at which the left load coupling structure connects to the left belt portion having the left load coupling structure connected to a first load, wherein the left load coupling structure includes a first hollow portion through which the left belt portion passes to form the left loop; and a right shoulder portion attached to the left shoulder portion and forms a right loop around and engages with the right shoulder region wherein the right shoulder portion further comprises:

a right belt portion that forms the right loop, and a right load coupling structure connected to the right belt portion to self-adjust a position at which the right load coupling structure connects to the right belt portion having the right load coupling structure connected to a second load, wherein the right load coupling structure includes a first hollow portion through which the right belt portion passes to form the right loop.

2. The exercise device of claim 1, wherein the left load coupling structure includes an extension structure that connects the first load to the left load coupling structure.

3. The exercise device of claim 2, wherein the extension structure includes a belt of adjustable length.

4. The exercise device of claim 3, further comprising a locking mechanism connected to the extension structure to adjustably fix a length of the extension structure.

5. The exercise device of claim 1, wherein the left load coupling structure comprises a hook structure to receive the first load.

6. The exercise device of claim 1, wherein the left load coupling structure is a plate in which the first hollow portion is formed, wherein the plate is connected to a hook structure.

7. The exercise device of claim 1, wherein the left load coupling structure slides along the left belt portion having the left load coupling structure connected to the first load.

8. The exercise device of claim 1, wherein the left load coupling structure and the right load coupling structure each automatically slides downward on the left belt portion and the right belt portion, respectively, having the left load coupling structure and the right load coupling structure connected to the first load and the second load, respectively, and having the left shoulder portion and the right shoulder portion engaged with the left shoulder region and the right shoulder region, respectively.

9. The exercise device of claim 1, wherein an engagement of the left shoulder portion and an engagement of the right shoulder portion are manually adjustable by buckles, having engaged with the left shoulder region, and the right shoulder region, respectively.

10. The exercise device of claim 9, wherein the left load coupling structure and the right load coupling structure slide on the left belt portion and on the right belt portion, respectively, having the left shoulder portion and the right shoulder portion engage with the left shoulder region and the right shoulder region, respectively.

11. The exercise device of claim 1, wherein the right shoulder portion is the same as the left shoulder portion.

12. The exercise device of claim 1, wherein the first load is a weighted object that is connected to the load coupling structure.

13. An exercise device comprising:

a pair of shoulder portions attached to each other, each shoulder portion forms a respective loop around and engages with a respective shoulder region of a human torso, wherein each shoulder portion comprises:

a respective belt portion that forms the respective loop, and a respective load coupling structure connected to the respective belt portion to self-adjust a respective position at which the respective load coupling structure connects to the respective belt portion having the respective load coupling structure connected to a respective load, wherein a left load coupling structure slides along a left belt portion having the left load coupling structure connected to the first load and, wherein a right load coupling structure slides along a right belt portion having the right load coupling structure connected to the second load.

14. The exercise device of claim 13, wherein each load coupling structure slides along the respective belt portion having each load coupling structure connected to the respective load.

15. The exercise device of claim 13, wherein each load coupling structure slides downward on the respective belt portion having each load coupling structure connected to the respective load, and having the pair of shoulder portions engaged with the shoulder region.

16. The exercise device of claim 13, wherein an engagement of each shoulder portion is manually adjustable by buckles, having the pair of shoulder portions engaged with the shoulder region.

17. The exercise device of claim 16, wherein each load coupling structure slides on the respective belt portion having the pair of shoulder portions engage with the shoulder region.

18. The exercise device of claim 17, wherein each load coupling structure automatically slides to a respective lowest vertical position on the respective belt portion having each load coupling structure connected to the respective load.

19. The exercise device of claim 13, wherein each load connected to each load coupling structure is a weighted object.

* * * * *